US006334376B1

(12) United States Patent
Torres

(10) Patent No.: US 6,334,376 B1
(45) Date of Patent: Jan. 1, 2002

(54) MECHANICAL TORQUE AMPLIFIER

(76) Inventor: Carlos A. Torres, 748 Blalock Rd., Houston, TX (US) 77024

( * ) Notice: Subject to any disclaimer, the term of this patent is extended or adjusted under 35 U.S.C. 154(b) by 0 days.

(21) Appl. No.: 09/686,537

(22) Filed: Oct. 11, 2000

Related U.S. Application Data

(60) Provisional application No. 60/159,230, filed on Oct. 13, 1999.

(51) Int. Cl.[7] ..... B25B 17/00
(52) U.S. Cl. ..... 81/372; 81/57.34; 81/57.36
(58) Field of Search ..... 81/57.16, 57.34, 81/57.36

(56) References Cited

U.S. PATENT DOCUMENTS

| | | | | |
|---|---|---|---|---|
| 4,938,109 A | | 7/1990 | Torres et al. | |
| 5,060,542 A | * | 10/1991 | Hauk | 81/57.16 X |
| 5,161,438 A | | 11/1992 | Pietras | |
| 5,386,746 A | * | 2/1995 | Hauk | 81/57.16 X |

* cited by examiner

*Primary Examiner*—James G. Smith

(74) *Attorney, Agent, or Firm*—Browning Bushman P.C.

(57) ABSTRACT

A power tong system is used to make up and break out threaded pipe connections. Rotary power tongs are connected to an integral backup tong through an extendable hydraulic cylinder and rod. A brake is secured to the rotary tong to selectively hold the pipe stationary relative to the rotary tong. When rotation of the pipe by the rotary tong ceases, the brake is applied, and the cylinder and rod are actuated to angularly displace the power tongs and the backup tong to apply a torque force to the pipe connection disposed between the power tongs and the backup. A resulting torque force is obtained that is greater than the maximum torque that can be exerted by the rotary tong acting alone. The system may also be deployed to apply and hold precise torque forces on the pipe connections. When used to obtain a makeup torque below the maximum rated rotary tong output, the rotary tong is regulated to limit its torque output. When the limited torque is reached, the brake is applied and the cylinder and rod are actuated to apply a smooth, closely controlled increase in torque to the connection. The final torque level may be held constant for a desired length of time. In both the high and low torque applications, the brake prevents the rotary tong from being turned backwardly by the increased torque force applied by actuation of the rod and cylinder assembly. Operation of the system may be manually or automatically controlled.

24 Claims, 2 Drawing Sheets

MECHANICAL TORQUE AMPLIFIER

This application claims benefit of Provisional Application Ser. No. 60/159,230 filed Oct. 3, 1999.

BACKGROUND OF THE INVENTION

1. Field of the Invention

The present invention relates to the application of torque forces to an object engaged by a wrench. More particularly, the present invention relates to the application of angular torque forces to a pipe that is being threadedly engaged to, or disengaged from, another pipe with the use of a hydraulic power tong.

2. Description of the Prior Art

Long strings of joined pipe sections are required for the drilling and completion of oil and gas wells. The pipe string is assembled by screwing together pipe sections, or "joints," typically 30–40 feet in length to make a long, continuous string of pipe that is lowered into the well as the joints are added. The joints are typically equipped with male "pin" threads at one pipe end and female "box" threads at the other pipe end. The string is extended by screwing the pin of the joint being added into the box at the top of the string.

During the early days of the drilling industry, the pipe string was screwed together in a two-step process using a "spinning rope" and a wrench called a "rig tong." One end of the spinning rope was wrapped around the joint being added to the string, and the opposite end was loosely wrapped around a rotating "cathead" powered by the drilling rig. An operator pulling on the tail end of the rope increased the friction of the wraps around the cathead causing the rope to spool over the cathead, pulling the rope away from the joint. A second operator simultaneously restrained the tail end of the rope wound on the pipe to force the pipe to rotate as the rope pulled toward the cathead, spinning the joint pin into the string box. The final makeup torque was applied to the connection using the rig tong, which was also pulled around the joint by the cathead rope.

Hydraulically powered wrenches, called "power tongs," were developed to replace the spinning rope and manual rig tongs. Power tongs typically include a tong body that surrounds the pipe to be rotated. The tong body carries a hydraulic motor driving a gear transmission connected to a rotary drive that engages and rotates the pipe. The rotary drive is generally equipped with appropriately sized jaws that are selectively actuated by the tong operator to grip the pipe to force the pipe to rotate with the rotary. The tong body is prevented from rotating around the pipe by attaching a restraint, or "snub line," between the tong and a support structure that is fixed relative to the angular motion of the joint being added to, or removed from, the string. In some cases, the support structure is the pipe string extending into the well, in which case an "integral backup tong," designed to grip the string to provide the required restraint, is also carried by the power tong body.

The torque generated by the power tong is monitored by measuring the force required to restrain the tong from rotating. If the snub line and the centerline of the tong are at a right angle with respect to each other, the torque applied to the pipe is equal to the measured force times the "tong arm" length. The tong arm length is the distance between the point of attachment of the snub line (or integral backup tong) to the tong body and the centerline of the engaged pipe. The power of the motor and the gear ratio of the transmission connecting the motor to the rotary determine the maximum torque that can be generated by a conventional rotary power tong.

In a typical application, the hydraulic power tong is used to rotate a pipe joint to screw the threads at one end of the joint into mating threads on another joint. Pipe sections having threads such as employed in many proprietary thread designs may be screwed together with very little initial torque until the shoulders in the thread profiles of the two connections engage. Once shoulder engagement occurs, the torque required to properly secure the connection increases substantially above the torque required to rotate the connection to the point of shoulder engagement. Following engagement of the shoulders, very little additional rotation occurs until the desired torque for the connection is obtained.

Most conventional systems used to automatically operate the tongs employ a control signal that bypasses, or "dumps," the hydraulic fluid pressure acting on the tong motor to disable the tong drive system when a desired torque value is sensed. Usually, the dump signal occurs suddenly while the tong motor is generating a high torque force. The weight and momentum of the typical tong prevent it from reacting instantaneously to the dump signal so that the torque applied to the engaged tubular body will frequently exceed the desired minimum torque value.

Another problem with conventional hydraulic power tongs is that the tongs may not provide sufficient power to release (break out) a connection that is made up to a high torque value. This may occur, for example, because the breakout torque of the connection is greater than its makeup torque. When specifying the type of tong to employ for such an application, it is necessary to specify a tong with a higher torque capacity than that required only to make up the pipe. Generally, the greater the torque required for a given job, the larger and more expensive the tong required to perform the job. A related factor is that the space available on most drilling or workover rigs is limited, and it is desirable to keep the equipment size as small as possible while still maintaining the ability to perform the required work.

U.S. Pat. No. 4,938,109 to Torres et al., assigned to the inventor of the present invention, discloses a hydraulic tong system that includes a power tong equipped with an auxiliary power mechanism that applies a force to the tong body to apply torque to the pipe through the stalled tong motor and transmission. The auxiliary power mechanism is preferably a hydraulic piston-cylinder assembly that can be extended or retracted to apply, and hold, the desired torque to a pipe gripped in the tong rotary.

While the Torres et al. system may be used to increase the maximum rated output of the power tong, it is generally used for applying torque to a connection where the desired optimum torque value is well below the maximum torque that can be applied by the tong motor. In such applications, the system is very effective in precisely applying the desired torque for most pipe connections; however, when the pipe is being made up to very low torque values, such as are required in the connections of fiberglass pipe and some other special pipe connections, the tong's transmission and motor are sometimes moved in reverse as the auxiliary power mechanism moves the tong body in a direction to increase the torque exerted on the gripped pipe. This typically occurs when the final makeup torque for the pipe is so low that it is necessary to limit the hydraulic pressure driving the motor to a level at which the tong motor stalls at a torque that is too low to resist the reverse forces acting through the transmission.

U.S. Pat. No. 5,161,438 describes a power tong that locks the rotary and the housing to prevent the rotary from turning in reverse as the housing is being pivoted with respect to the rotational axis of the rotary. A bolt (or bolts) is used to inhibit the relative rotation. A piston-cylinder arrangement is used for pivoting the housing. All torque generated in the patented system is transmitted through the main rotary gear of the tong.

SUMMARY OF THE INVENTION

An integral pipe brake mounted on a rotary power tong grips the pipe as a hydraulic piston-cylinder assembly applies angular force to the tong body. The torque applied to the pipe by the piston-cylinder assembly exceeds that internally generated by the tong. The brake isolates the main rotary gear and transmission from the externally generated torque and prevents the tong body from rotating relative to the pipe while the piston-cylinder assembly is angularly displacing the tong body.

The pipe brake may be actuated to engage automatically once the piston-cylinder assembly is actuated, or the brake may be manually directed by an operator to engage as required. When employed with integral backup tongs, the system may also be automatically or manually actuated to control the selective gripping, release, and rotation of the pipe as required to make or break a pipe connection.

In one embodiment of the invention used to apply a precise, relatively low value of torque to a connection, a regulator is employed to limit the power generated by the hydraulic tong motor. A piston-cylinder assembly is employed to apply the final torque to the connection. In this application, the regulator is set so that the tong motor can produce just enough torque to rotate the pipe until the shoulders in the mating pin and box are engaged. When the shoulders engage, the tong motor stalls, causing the pipe rotation to stop; the brake is manually or automatically engaged with the pipe; and the hydraulic piston-cylinder is manually or automatically actuated to pull the power tong and brake around the gripped pipe until the desired final torque is applied to the connection. The brake isolates the motor and transmission from the piston-cylinder applied torque and prevents them from turning in reverse as the tong body is pulled around the pipe.

The system of the present invention allows the tong motor to spin up the pipe at a relatively rapid rate until the thread shoulders in the connection engage and stop the rotation. Additional torque is applied until some limited value of torque, well below the minimum torque, is reached. Limiting the initial torque output of the tong motor to a value below the desired torque minimum value is done through the tong drive train. The minimum torque is not exceeded because the torque application is automatically limited to a value that is sufficiently low to prevent the momentum of the tong from reaching the minimum torque value after the hydraulic tong motor power is bypassed. Regulating the hydraulic pressure across the tong motor, rather than dumping the pressure and bypassing the motor, allows the tong to maintain the attained low value of torque on the connection until additional torque is slowly and precisely applied by the operation of the piston-cylinder assembly.

When torque above that capable of being produced by the tong motor alone is required, the brake is set and the hydraulic piston-cylinder is actuated to pull the tong body and the gripped pipe in a direction to increase torque on the pipe. The torque magnitude generated by pulling the tong body with the piston-cylinder assembly is equal to the pulling force of the cylinder multiplied by the effective tong arm length. The hydraulic pressure acting on the effective cross-sectional areas of the cylinder piston and connecting rod determine the pulling force of the cylinder.

For a given value of hydraulic pressure operating both the tong motor and the pulling piston-cylinder assembly, a cylinder with a suitably sized piston and rod is capable of applying a significantly greater torque to the pipe than that which can be applied by a conventional tong motor alone.

The hydraulic pressure employed to power a typical hydraulic power tong is generally in the range of 2,000 to 3,000 psi. Depending upon the tong transmission and motor specifications, these pressures can typically produce output torques that range from 6,000 to 60,000 foot pounds. In smaller tongs, such as those designed to run small tubing sized pipe, the torque output with 2,000 psi hydraulic pressure is approximately 6,000 foot pounds. A hydraulic piston-cylinder assembly having an effective cross-sectional area with as little as four square inches of pressure-responsive area can produce a force of 8,000 lbs. in a 2,000 psi hydraulic system. This same 8,000 lbs. acting on a 2-foot long arm can produce 16,000 foot pounds of torque. Accordingly, it will be appreciated that the use of a piston-cylinder assembly in a relatively low pressure hydraulic system can be employed to generate relatively high torque value in a conventional power tong equipped with the pipe brake of the present invention.

When it is necessary to break out a connection in the pipe with a torque that exceeds the torque capacity of the tong motor, the hydraulic piston-cylinder assembly is actuated with the brake set. The connection is broken by the high torque output of the assembly so that the tong motor torque becomes adequate to rotate the engaged pipe, whereupon the cylinder movement is stopped, the brake is released, and the tong motor is engaged to rotate the pipe completely free of the connection with the string.

The hydraulic pressure system used to power the tong motor may be the same as that employed to activate the piston cylinder assembly. Application of torque through the contraction or expansion action of the piston-cylinder assembly applies a controlled, linear change in the torque, as contrasted with the uncontrolled, rapid change in torque that occurs when torque is applied solely by the tong motor.

In a preferred form of the invention, the integral brake locks the tong body to the pipe to relieve the tong motor and transmission components from the amplified torque forces being exerted by the piston-cylinder assembly.

The method of the present invention permits the use of amplified torque applied by the piston-cylinder assembly to overcome the high breakout torque required to initiate the disengagement of the threaded connection. Once the piston-cylinder assembly has applied sufficient breakout torque, the torque required to continue rotation of the pipe can be applied by the rotary tong to complete disengagement of the connection.

During makeup of a pipe connection, the tong motor rotates the pipe being added to the string and applies as much final, non-rotating torque as may be obtained from the motor. Once the shoulders in the threaded connections engage, rotation of the pipe stops, and the brake is set to fix the tong body relative to the pipe. The piston-cylinder assembly is then actuated to rotate the pipe relative to the string to thereby increase the torque above the maximum output of the tong motor, to a maximum desired value.

When employed for making up or breaking out pipe at torque values above those capable of being generated by the tong motor alone, the pipe may be rotated rapidly by the power tong rotary drive during that part of the makeup or breakout at which the torque required to rotate the pipe is less than the torque rating of the motor. Use of the rotary tong to perform the major portion of the rotation of the pipe increases the speed of engaging or disengaging pipe in the string as compared with using manual tongs, which require repeated wrenching movement to completely make up or break out a connection.

DESCRIPTION OF THE ILLUSTRATED EMBODIMENTS

Figure 1:
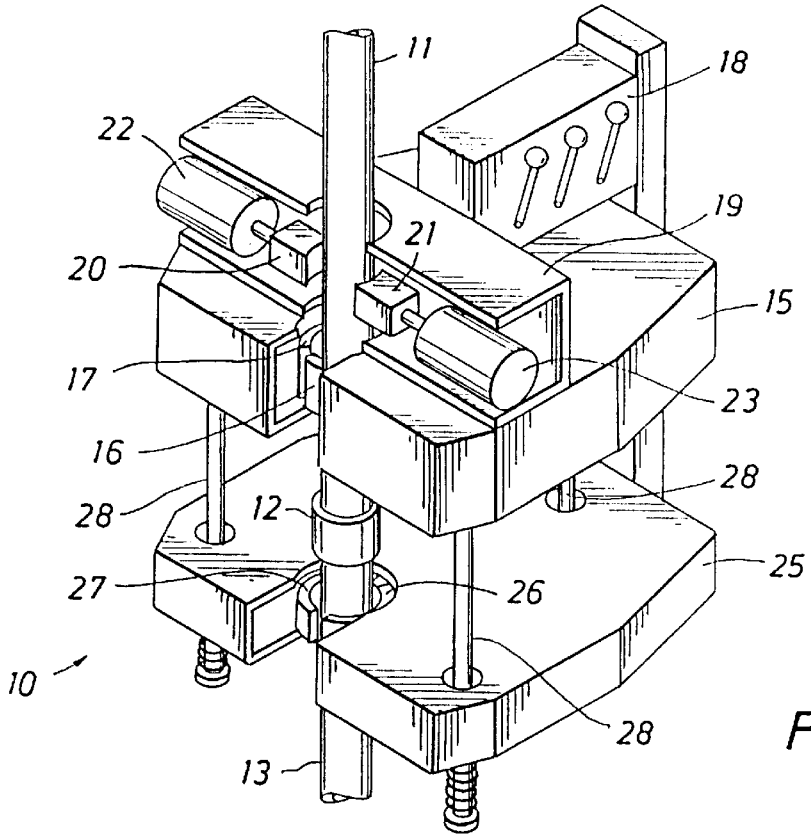
FIG. 1 is an elevation, in perspective, illustrating a hydraulic power tong equipped with the torque amplification and control system of the present invention.
Figure 2:
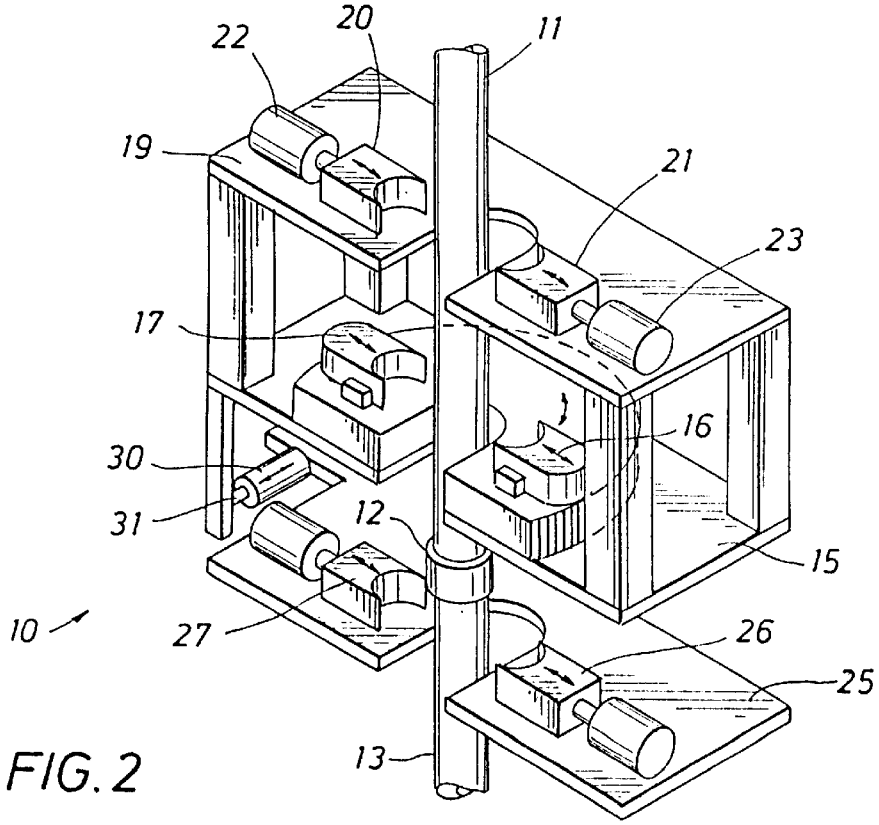
FIG. 2 is a schematic representation of the power tong of FIG. 1 of the present invention illustrating details in the operation of the rotary and backup assemblies of the system.

The tong assembly of the present invention is indicated generally at 10 in FIG. 1. FIG. 2 schematically illustrates the major operative components of the assembly 10. Similar reference characters in FIGS. 1 and 2 signify the same or similar components. The assembly 10 is illustrated in a position about a pipe string segment comprised of an upper pipe joint 11, a coupling assembly 12, and a lower pipe joint 13. A primary rotary power section 15 of the assembly 10 is employed to rotate the pipe string. The assembly 10 engages the pipe joint 11 with jaws 16 and 17 carried in the rotary and adapted to grip and hold the pipe joint while the rotary turns. The jaws 16 and 17 operate conventionally and are designed to be selectively moved radially into and out of engagement with the pipe by circumferential displacement of camming surfaces formed between the jaws and the tong rotary. An operator-managed hydraulic system 18 controls the gripping, rotation, and power application of the tong section 15.

An integral pipe brake 19 secured to the tong section 15 is equipped with brake jaws 20 and 21 that selectively engage the pipe joint 11, preventing the pipe joint from rotating relative to the section 15. The brake jaws 20 and 21 are moved radially into and out of engagement with the pipe joint 11 by appropriately powering hydraulic cylinders 22 and 23 from the hydraulic system 18.

An integral backup tong 25 carried by the section 15 is equipped with jaws 26 and 27 that engage the pipe section 13 below the coupling 12 to limit rotation of the section 15 relative to the pipe section 13. The jaws 26 and 27 are powered by the hydraulic system to move radially into engagement with the pipe section 13 to prevent relative rotation between the assembly 25 and the pipe section 13. The backup assembly 25 is supported from the tong section 15 by axial supports 28 that permit limited relative axial and angular displacement between the backup assembly 25 and the tong section 15.

With joint reference to FIGS. 1 and 2, the primary rotary power section 15 is connected to the backup assembly 25 by a hydraulic assembly of a cylinder 30 and rod 31. The cylinder and rod assembly can be extended or contracted to selectively rotate the section 15 and assembly 25 relative to each other about the common pipe axis to apply a torque force to the connection of the pipe and the coupling.

In operation, using the assembly 10 to make up a pipe string being lowered into a well, the pin end of a pipe joint 11 is lowered into the box end of a coupling 12, and the assembly 10 is moved into position over the pipe, as illustrated in FIG. 1. The operator actuates the backup assembly to close the jaws 26 and 27 about the pipe joint 13. This locks the entire assembly 10 to the pipe joint 13 to limit relative angular and axial movement of the assembly 10 relative to the pipe joint 13. The operator then actuates the primary rotary section 15 to engage the jaws 16 and 17 with the pipe joint 11. The power tong section 15 is then actuated to rotate the pipe joint 11, causing the pin threads in the joint 11 to engage in the box threads of the coupling 12.

In one procedure of the present invention, the power tong section 15 is initially operated to spin the pipe 11 and apply its maximum rotary torque to the joint 11 after the spinning ceases. The pipe brake 19 is then actuated to move the jaws 20 and 21 into engagement with the pipe joint 11, locking the tong section 15 relative to the pipe joint 11. The hydraulic cylinder 30 is then actuated to retract the rod 31, causing an angular force to be created between the backup assembly 25 and the tong section 15 and its integral brake 19. With sufficient hydraulic pressure, the retraction of the rod induces a torque force applied to the pipe-coupling connection greater than that capable of being obtained through the tong rotary.

When the assembly 10 is employed to remove pipe joints from a string, the assembly is moved into the position illustrated in FIG. 1, and the backup assembly 25 is engaged with the pipe join 13. The pipe brake 19 is then closed over the pipe joint 11, and the hydraulic cylinder 30 is actuated to extend the rod 31. This motion applies a high release torque to the connection at the coupling, causing the joint 11 to rotate relative to the joint 13. The release torque is typically adequate to rotate the pipe sufficiently to reduce the breakout torque to a level that can be exerted by the tong rotary section 15. The pipe brake 19 is released once the required breakout movement has been applied, and the tong section 15 is actuated to engage the joint 11 and rotate the joint 11 fully out of the coupling 12.

Figure 3:
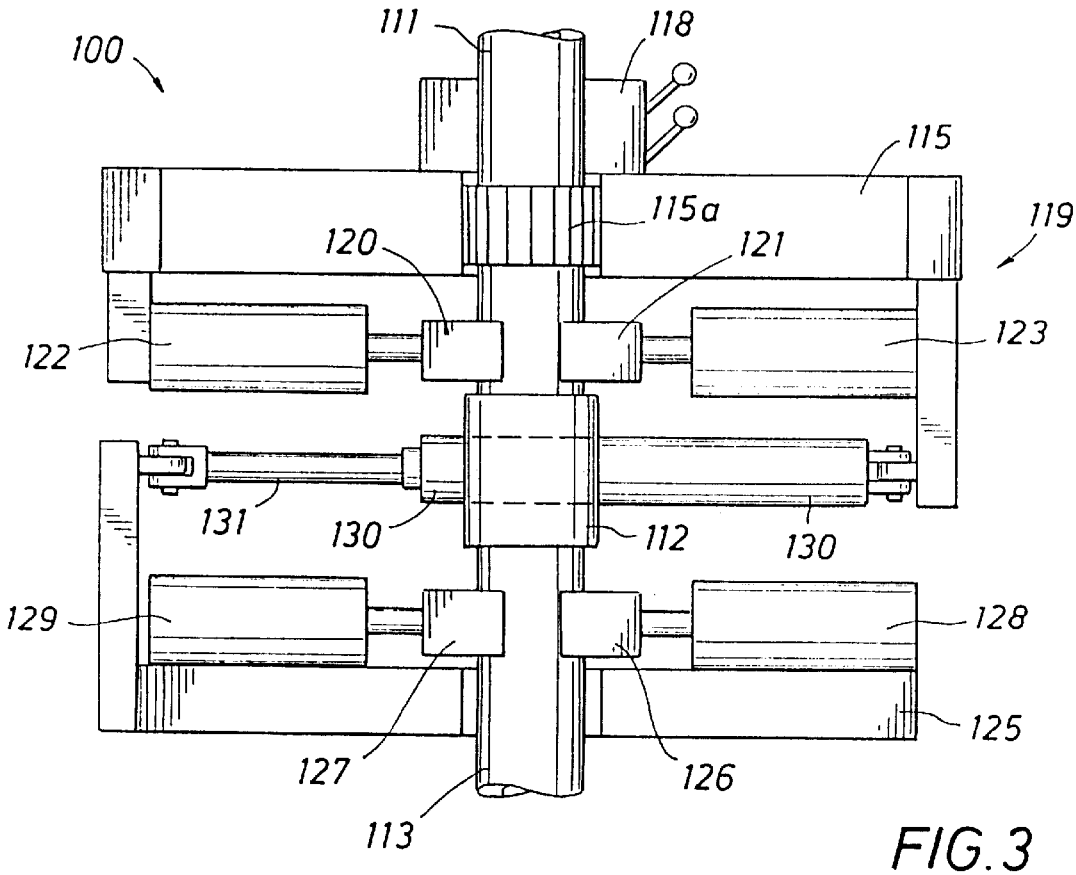
FIG. 3 is a schematic representation of a modified form of the power tong assembly of the present invention.
Figure 4:
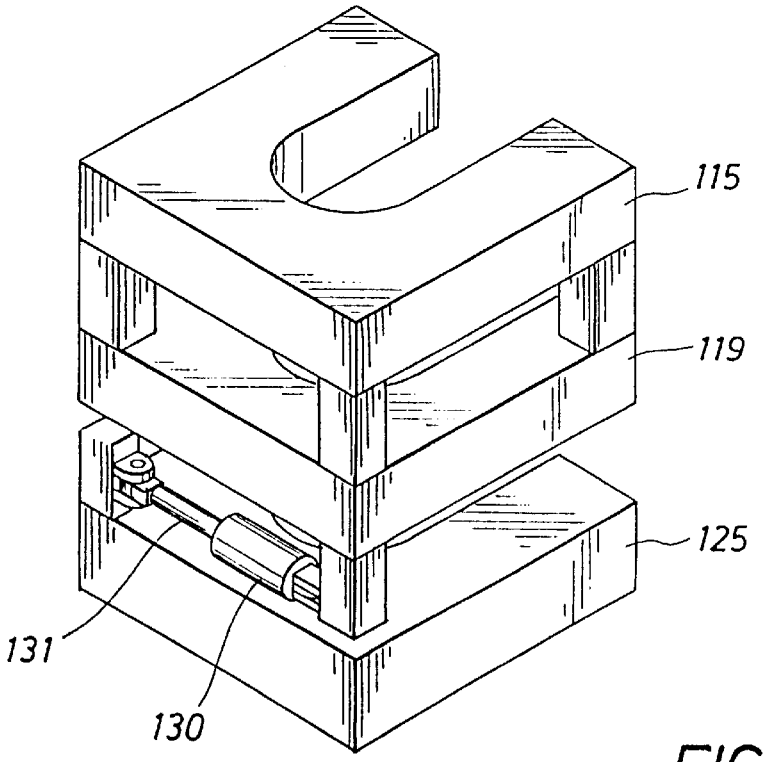
FIG. 4 is a schematic rear view of the tong assembly illustrated in FIG. 3.

FIG. 3 illustrates a modified form of the assembly of the present invention, indicated generally at 100. FIG. 4 schematically illustrates the major functional features of the tong assembly 100. The same reference characters identify similar components in FIGS. 3 and 4. The reference characters of FIGS. 3 and 4 are higher by 100 than those of similar components identified in FIGS. 1 and 2.

The tong assembly 100 includes a rotary tong section 115 driven and controlled by a hydraulic section 118. An integral pipe brake indicated generally at 119 is carried below the rotary tong section 115. Pipe-engaging jaws 120 and 121 are carried by hydraulic cylinders 122 and 123, respectively.

An integral backup tong 125 employs pipe-engaging jaws 126 and 127 carried at the ends of rods extending from hydraulic cylinders 128 and 129, respectively.

A hydraulic assembly of a cylinder 130 and rod 131 extends between the backup assembly 125 and the pipe brake 119. Extension or retraction of the assembly of the cylinder 130 and rod 131 moves the backup tong 125 angularly relative to the rotary tong 115 and integral pipe brake 119.

In operation, the assembly 100 is moved over the pipe string, and the integral backup 125 is activated to drive the pipe jaws 126 and 127 into gripping engagement with the pipe section 113. The rotary tong section 115 is then actuated to cause the jaws (not illustrated) carried by the rotary 115*a* to engage the pipe section 111. The rotary of the tong section 115 is rotated, causing the connection 111 to threadedly engage into the coupling 112. Once rotation of the connection 111 is stopped, either because of the engagement of threaded shoulders in the connection or because the maximum torque output of the rotary tong has been reached, the pipe brake 119 is actuated to engage the jaws 120 and 121 with the pipe section 111. The hydraulic cylinder 130 and rod 131 are then activated to extend the rod from the cylinder, causing the integral backup tong 125 to be angularly displaced relative to the rotary tong 115 and brake assembly 119. Because of the fixed engagement of the backup tong 125 with the pipe 113 and the fixed engagement of the brake 119 with the pipe section 111, relative angular displacement between the backup tong and the brake causes the torque in the connection between the pipe section 111 and the coupling 112 to increase.

The tong system 100 may also be employed to breakout connections having a breakout torque greater than that capable of being exerted by the rotary tong section 115 alone. In such applications, the backup tong 125 is engaged with the pipe section 113, and the brake 119 is engaged with the pipe section 111. The hydraulic cylinder 130 and rod 131 assembly is then contracted to rotate the tong and brake relative to each other to exert a breakout torque on the connection. Brake 119 is then released from the pipe section 111, and the rotary tong section 115 rotates the pipe section 111 to complete the unthreading of the connection.

The precise application of low torque to a connection, for torque values below the maximum rated output of the rotary tong, may be performed in the manner previously described with reference to the system of FIGS. 1 and 2. In this application, the control 118 is adjusted so that the maximum torque output of the rotary tong section 115 is limited to approximately 70% or 80% of the desired optimum torque value to be applied to the connection. Once this initial maximum torque value is applied to the connection, the brake 119 is closed on the pipe, and the cylinder-rod assembly 130, 131 is actuated to increase the torque applied to the connection. The smooth, slow stroking of the cylinder-rod assembly applies to the connection controlled, linearly increasing torque that can be precisely set and held.

While the preferred form of the invention has been described using a hydraulic cylinder-rod assembly for the force-applying mechanism employed to angularly displace the two wrench components holding the adjoining pipe segments, it may be appreciated that other suitable force-applying devices may be employed. Thus, by way of example rather than limitation, the force-applying mechanism may be electrically, pneumatically, or mechanically driven and may include gear-driven, belt-driven, or other mechanically driven devices. It will also be appreciated that while the present invention has been described particularly for use with threaded tubular goods, the invention may be employed to make up or break out other threaded components, such as bolts and other devices that require the controlled application of torque and rotation.

It will also be understood that while the tong restraining device has been described as an integral backup tong, the power tong may be restrained by a conventional snub line comprised in part by the cylinder-rod assembly. Accordingly, while a preferred form of the invention has been described in detail herein, various modifications in the materials of construction, the methods of operation, and the assembly and use of the invention may be made without departing from the spirit and scope of the present invention, which is intended to be limited only by the following claims.

What is claimed is:

1. A torque application device, comprising:

a rotary power tong having a support structure, a rotary drive carried by said support structure for rotating a first rotatable body, a brake carried by said support structure and adapted to selectively engage said first rotatable body to prevent said first rotatable body from rotating relative to said support structure, a backup connected with said rotary power tong and adapted to engage a second rotatable body to prevent said second rotatable body from rotating relative to said backup, and a torque multiplier for applying a torsional force tending to rotate said rotary power tong and said backup relative to each other to impose a torsional force between said first and second rotatable bodies.

2. A torque application device as defined in claim 1 wherein said rotary power tong is powered by pressurized hydraulic fluid and said brake is powered by pressurized hydraulic fluid.

3. A torque application device is defined in claim 2 wherein said rotary power tong and said brake are powered from the same source of pressurized hydraulic fluid.

4. A torque application device as defined in claim 1 wherein said backup is connected to said rotary power tong.

5. A torque application device as defined in claim 1, wherein:

said rotary power tong includes a rotary transmission acting through tong jaws for selectively engaging and rotating said first rotatable body, and said brake includes hydraulically actuated gripping members for engaging and preventing rotation of said first rotatable body relative to said support structure.

6. A torque application device as defined in claim 1 wherein said torque multiplier includes a hydraulic piston and rod assembly for applying a torsional force to said first and second rotatable bodies engaged by said brake and said backup tong.

7. A torque application device as defined in claim 1 wherein said backup is connected with said support structure and is rotatable relative to said support structure.

8. A torque application device as defined in claim 7 wherein said backup is connected with said support structure by a hydraulic piston and rod assembly for a torsional force to said first and second rotatable bodies engaged by said brake and said backup tong.

9. A torque application device as defined in claim 1 wherein said brake is interposed between said rotary power tong and said backup.

10. A torque application device said defined in claim 1 further comprising a torque control for controlling the torsion applied by said torque multiplier.

11. A torque application device as defined in claim 1 further comprising controls for regulating the gripping, rotation, braking, release and torque application of said torque application device.

12. A torque application device as defined in claim 6 wherein said torque multiplier includes a control for regulating the linear expansion and contraction of said hydraulic piston and rod assembly for applying and holding a controlled torque between said first and second rotatable bodies.

13. A method of making up first and second threaded bodies connectable together by their threads, comprising:

gripping said first threaded body with a rotary drive of a rotary power tong gripping said second threaded body with a backup tong, rotating said first threaded body with said rotary drive while said second threaded body is held from rotation by said backup tong, gripping said first threaded body with a brake connected with said rotary power tong to prevent rotation of said first threaded body relative to said power tong, and applying a torsional force between said brake and said backup tong for applying a torsional force between said first and second threaded bodies.

14. A method as defined in claim 13 wherein said rotary drive rotates said first threaded body until threads connecting said first and second threaded bodies reach a limiting make up torque or shoulder to prevent further rotation.

15. A method as defined in claim 14 wherein said torsional force is applied between said first and second threaded bodies after threads connecting said first and second threaded bodies shoulder or reach a limiting make up torque.

16. A method of breaking out first and second threaded bodies connected together by threads, comprising:

gripping said first threaded body with a brake that is connected with a rotary power tong, gripping said second threaded body with a backup tong, applying a torsional force between said brake and said backup tong for applying a torsional force between said first and second threaded bodies, releasing said brake, and rotating said first threaded body with a rotary drive of said power tong to unthread said first threaded body from said second threaded body.

17. A method as defined in claim 16 wherein said torsional force is applied until the torque required to rotate said first threaded body is within the rotating power capacity of said rotary tong.

18. A method of applying controlled torque to a threaded connection between first and second rotatable threaded bodies, comprising:

gripping said first threaded body in the rotary drive of a power tong, gripping said second threaded body in a backup tong to prevent rotation of said second threaded body, rotating the threads of said first threaded body into the threads of said second threaded body with said rotary drive until a limiting torque value is reached between said first and second threaded bodies or the threads of said first and second threaded bodies shoulder to prevent continued rotation between the first and second threaded bodies, engaging said first threaded body with a brake carried by said power tong, and applying a torsional force between said brake and said backup tong to increase the torque in the connection of said first and second threaded bodies.

19. A method as defined in claim 18 wherein said brake is positioned between said rotary drive of said power tong and said backup tong.

20. A method as defined in claim 18 wherein said torsional force is applied by a hydraulic cylinder and rod assembly that rotates the brake relative to the backup tong.

21. A method as defined in claim 18 wherein said first and second threaded bodies are lengths of completion tubing and a final make up torque for the connection of the threads of said first and second threaded bodies is applied with said torsional force.

22. A method as defined in claim 21 wherein said a torsional force is applied through a hydraulic cylinder and rod assembly that rotates the brake relative to the backup tong.

23. A power wrench for rotating and applying torque to an object, comprising:

a wrench body;

a rotary rotatably mounted on said wrench body;

a gripping assembly carried by said rotary for gripping and holding said object;

a motor having a rotary output power drive mounted on said wrench body;

a transmission connecting said power drive motor with said rotary whereby rotation of said power drive rotates said rotary;

a power amplifier for applying force to said wrench body in a direction that applies torque to an object gripped and held by said gripping assembly; and a brake for preventing rotation of said rotary relative to said wrench body when said power amplifier is applying force to said wrench body.

24. A wrench for applying angular torque force to an engaged member, comprising:

a wrench body;

a gripping head mounted in the wrench body for gripping said engaged member and applying angular torque to said engaged member relative to said wrench body;

a motor mounted on said wrench body;

a transmission between said motor and said gripping head for transmitting motor force to said gripping head for applying said angular torque to said engaged member;

a first force limit control for regulating the amount of angular force exerted by said gripping head;

an angular torque force multiplier connected to said wrench body for moving said wrench body angularly relative to said engaged member; and a lock control independent of said transmission for preventing said gripping head from rotating relative to said wrench body when said torque force multiplier is applying angular motion to said wrench body.

* * * * *